US006343417B1

(12) United States Patent
Bonny et al.

(10) Patent No.: US 6,343,417 B1
(45) Date of Patent: Feb. 5, 2002

(54) PROCESS OF MANUFACTURING AN AIR-GAP-INSULATING EXHAUST ELBOW OF A VEHICLE EXHAUST SYSTEM

(75) Inventors: Pierre Bonny, Hamburg; Thomas Huelsberg, Rosengarten, both of (DE)

(73) Assignee: Daimler-Benz Aktiengesellschaft, Stuttgart (DE)

( * ) Notice: Subject to any disclaimer, the term of this patent is extended or adjusted under 35 U.S.C. 154(b) by 0 days.

(21) Appl. No.: 09/201,132

(22) Filed: Nov. 30, 1998

(30) Foreign Application Priority Data

Nov. 28, 1997 (DE) ..... 197 52 773

(51) Int. Cl.[7] ..... B23B 15/26
(52) U.S. Cl. ..... 29/890.08; 29/455.1
(58) Field of Search ..... 29/890.08, 523, 29/455.1, 421.1; 72/58, 61, 62

(56) References Cited

U.S. PATENT DOCUMENTS 4,840,053 A * 6/1989 Nakamura ..... 72/58
4,928,509 A * 5/1990 Nakamura ..... 72/61
5,170,557 A 12/1992 Rigsby (List continued on next page.)

FOREIGN PATENT DOCUMENTS

| | | |
|---|---|---|
| DE | 41 03 083 | 5/1992 |
| DE | 43 39 290 | 5/1995 |
| DE | WO 95/31635 | 11/1995 |
| DE | 195 46 509 | 12/1995 |
| DE | 44 28 435 | 2/1996 |
| DE | 195 11 514 | 8/1996 |
| DE | 195 18 252 | 11/1996 |
| DE | 197 13411 | 10/1998 |
| EP | 0 582 985 | 8/1993 |
| EP | 0623739 | 2/1994 |
| EP | 0 627 272 | 5/1994 |
| EP | 0761335 | 3/1997 |

OTHER PUBLICATIONS

Oppositions in a proceeding with the German Patent Office re German Patent Application No. DE 197 52 773.6–13 (German language original with English translation).
Response to Opposition to German Patent Document No. DE 197 52 773.6–13 (German language original with English translation).
Opposition in a proceeding with the German Patent Office re German Patent Application No. DE 197 52 772.8–13 (German language original with English translation).
Response to Opposition to German Patent Document No. DE 197 52 772.8–13 (German language original with English translation).

*Primary Examiner*—I Cuda Rosenbaum
(74) *Attorney, Agent, or Firm*—Crowell & Moring, L.L.P.

(57) ABSTRACT

A process for manufacturing an air-gap-insulated exhaust elbow of a motor vehicle exhaust system achieves in a simple manner a manufacturing of space-saving air-gap-insulating exhaust elbows which is reliable with respect to the process and can be precisely reproduced. The exhaust elbow is joined together from several air-gap-insulated exhaust pipes as well as the pertaining entry flanges and the exit flange, which, by way of an internal high-pressure metal forming process, are shaped in an air-gap-insulating manner from one double pipe respectively. The ends of the air-gap-insulated exhaust pipes which are to be connected with one another are first trimmed while opening the respective air insulating gap and are then fitted into one another. In such case, the ends are shaped such that the fitted connections of the outer pipes and of the inner pipes of the exhaust pipes to be connected are made with play. The mutually connected outer pipe ends of the exhaust pipes are welded together at the point of their fitted connection while forming a circular bead. The connection-free ends of the exhaust pipes to be connected to the cylinder head are fitted together with the respective pertaining entry flanges and are welded together and the connection-free end, which faces away from the cylinder head, of the last one of the branched exhaust pipes arranged in a row side-by-side, is fitted together with the exit flange and is welded to the latter.

25 Claims, 2 Drawing Sheets

U.S. PATENT DOCUMENTS 5,189,790 A * 3/1993 Streubel et al. ..... 29/890.149
5,363,544 A * 11/1994 Wells et al. ..... 29/523
5,390,494 A 2/1995 Clegg
5,475,911 A * 12/1995 Wells et al. ..... 29/512
5,582,052 A * 12/1996 Rigsby ..... 72/62
5,600,983 A 2/1997 Rigsby
5,673,470 A * 10/1997 Dehlinger et al. ..... 29/421.1
5,682,741 A 11/1997 Augustin et al. ..... 60/323
5,697,155 A 12/1997 Bloecker et al. ..... 29/890.148
5,799,395 A * 9/1998 Nording et al. ..... 29/890.08
5,816,045 A * 10/1998 Blocker et al. ..... 29/890.08
5,836,065 A * 11/1998 Dehlinger et al. ..... 29/33 T
5,970,939 A * 10/1999 Motosugi et al. ..... 29/890.08
6,026,570 A * 2/2000 Bohm et al. ..... 29/890.08
6,038,769 A * 3/2000 Bonny et al. ..... 29/890.08

* cited by examiner

PROCESS OF MANUFACTURING AN AIR-GAP-INSULATING EXHAUST ELBOW OF A VEHICLE EXHAUST SYSTEM

BACKGROUND OF THE INVENTION

This application claims the priority of German patent document 197 52 773.6, filed Nov. 28, 1997, the disclosure of which is expressly incorporated by reference herein. Commonly-assigned U.S. patent application Ser. No. 09/201,134, identifying the same inventors, having the same filing date, and corresponding to the same subject matter of the present application, is referenced.

The present invention relates to a process for manufacturing an air-gap-insulated exhaust elbow of an exhaust system of a vehicle which contains an exhaust-gas-carrying inner pipe constructed as a pipe bend. At least one branched inner pipe adjoins the pipe bend. The system further includes an outer jacket as well as entry flanges for fastening the exhaust elbow to a cylinder head of an internal-combustion engine and an exit flange for coupling the exhaust elbow to the additional exhaust gas pipe systems. The inner pipe is constructed as a pipe bend, on one end, and is connected by way of a sliding fit with one end of the inner pipe of the branched inner pipe. The other end of the pipe bend and the branching of the branched inner pipe are fixedly connected with one entry flange respectively. The outer jacket is fixedly connected in the area of the end of the branched inner pipe which is free of a connection with an entry flange and or inner pipe of an exhaust pipe, being fixedly connected with the exit flange, and the outer jacket being arranged at a distance around the inner pipes while forming the air insulating gap.

DE 195 11 514 C1 describes a process for manufacturing an exhaust elbow which consists of several inner pipes, which are fitted into one another by a sliding fit, an outer jacket, entry flanges and an exit flange. The outer jacket is constructed in a half-shell design, the fitted composite of the inner pipes (pipe bend, T-piece, branching pipe with the connection to the exit flange) being placed into a lower outer jacket half shell. Then the upper half shell is pressed onto the lower half shell and is welded to the lower half shell while forming a double-flanged seam between the inner pipe ends.

The fitted composite of the inner pipes in the known process is centered within the outer jacket in a high-expenditure manner by special spacer rings which are pushed onto several inner pipes, the gap which is created in this case forming the future air insulating gap. The spacer rings consist of a material which decomposes and/or sublimes under the effect of heat, particularly during the engine operation. Since, on the one hand, the individual pipes having manufacturing tolerances can be slid with respect to one another and, because of the mounting operation, have different fitting lengths from one fitted composite to the next. On the other hand, the spacer rings themselves are subjected to manufacturing tolerances and, because of their design relative to the construction of the bottom shell, will rarely rest against it in a surrounding manner. The manufacturing of the whole exhaust elbow is subjected to tolerances even under these aspects. In the above-mentioned manufacturing tolerances, the inner pipe with the branching connection piece is virtually never situated with the desired defined surrounding air gap inside the outer jacket. A precise reproducibility does not exist here.

During the assembly, care must be taken that a certain minimal fitting length is maintained so that the individual inner pipes will not slide apart. This maintenance of the minimal fitting length requires perceptiveness and considerable expenditures. Vibrations and centrifugal forces may also occur during the transfer of parts to the welding station, which leads to another shifting of the individual inner pipes with respect to one another and with respect to the bottom shell of the outer jacket. This may even lead to a disassembly of the fitted composite.

Because of the rebound distortion of the two sheet metal half shells after the deep-drawing, the two outer jacket half shells do not continuously rest unaided against one another in a close-fitting manner and therefore without any gap. In the welding station, the top shell of the outer jacket is therefore placed onto the bottom shell and pressed against it. Vibrations will also occur here which affect the fitted composite, and there is a displacement of the relative position of the branched inner pipe in the outer jacket.

Finally, the shells of the outer jacket are laser-welded to one another. After the contact pressing is eliminated, because of the non-uniformity of the contact surfaces of the half shells, considerable tension forces are exercised on the weld seam. This reduces the continuous loadability of the assembly, particular of the outer jacket, and, in the operation of the exhaust gas system, may even lead to a failure of the component. The process reliability of the manufacturing of the exhaust elbow, on the whole, is therefore not sufficiently ensured.

The welding-together of the half shells while forming a double flanged seam also requires relatively high expenditures, particularly since, at the transition to the cutout of the outer jacket for the branching connection piece of the inner pipe, because of edge radii, a triangular wedge is formed which must be closed by welding for ensuring the reliability of the process which, in practice, can be carried out only by a filler metal. In addition, because of its design, the double flanged seam can be mechanically stressed to a limited extent. Also, for fixing the inner pipe to the outer jacket, a welded connection is required while forming a circular seam, i.e., a surrounding fillet weld seam, in the end area of the branching connection piece. The end of the inner pipe of the connection piece is slightly set back with respect to the opening of the outer jacket.

In addition, particularly because of the branched exhaust pipe, the outer pipe spatially has a very projecting construction because, when the half shells are deep drawn, no branching can be achieved. Thus, a construction of an outer jacket which is true to the contours can, therefore, not be obtained with respect to the design of the inner pipe. All inner pipes are integrally enclosed by a single common outer jacket, whereby, because of the uniform end of the outer jacket approximately in the plane of the entry flange, relatively large-volume sheet metal sections of the outer jacket are formed between the inner pipes adjoining the entry flanges which require considerable space, increase the weight of the branched exhaust pipe and result in additional unnecessary expenditures of material. As a result, the construction of a defined completely uniform air gap also cannot be achieved in the branched exhaust pipe.

Furthermore, because of the outer jacket, engines of different numbers of cylinders require exhaust elbows of different constructions. This results in high additional manufacturing and tool expenditures connected with the corresponding costs. Also, for differently designed spaces, new variants of the exhaust elbow construction in the half shell design must be thought up which are adapted to these spaces. The respective implementation also requires considerable manufacturing expenditures.

SUMMARY OF THE INVENTION

An object of the present invention to provide an improved process such that a manufacturing of space-saving air-gap insulating exhaust elbows is achieved in a simple manner which is process-reliable and can be precisely reproduced.

According to the present invention, this object has been achieved by providing that the exhaust elbow is joined together of several air-gap-insulated exhaust pipes composed of a pipe-bend-shaped and at least one branched exhaust pipe, as well as the pertaining entry flanges and the exit flange. The exhaust pipes are shaped in an air-gap-insulated manner by an internal high-pressure metal forming process for one double pipe respectively consisting of two mutually coaxially arranged pipes in an internal high-pressure metal forming tool with the introduction of a pressure fluid between the exterior wall of the inner pipe and the interior wall of the outer pipe of the double pipe forming the outer jacket. While forming a passage opening from the inner pipe toward the outside, at the end of the branching connection piece, a double-walled section is cut out. The ends of the air-gap-insulated exhaust pipes which are to be connected with one another are first trimmed while opening up the respective air insulating gap and are then fitted into one another. The ends are shaped such that the fitted connections of the outer pipes and of the inner pipes of the exhaust pipes to be connected are made with play. The mutually connected outer pipe ends of the exhaust pipes are welded to one another at the point of their fitted connection while forming a surrounding fillet weld. The connection-free ends of the exhaust pipes which are to be connected to the cylinder head are fitted together with the respective pertaining entry flanges and are welded together and the connection-free end, which faces away from the cylinder head, of one of the branched exhaust pipes is fitted together with the exit flange and is welded thereto.

The present invention permits a modular design of the exhaust elbow, in which exhaust elbows, which have an arbitrary configuration with respect to their dimension and constructional depth, can be manufactured in a simple manner from air-gap-insulated individual exhaust pipes which are fitted into one another. The outer pipes of the individual exhaust pipes are welded to one another, and the inner pipes are positioned in one another by a sliding fit.

The individual modules form the individual exhaust pipes which represent standard structural elements and therefore production goods which can be manufactured at low cost. Thus, because of the simple joining of identical parts of the branched exhaust pipes, for example, consisting of a four-cylinder exhaust elbow, a 6-cylinder or 8-cylinder exhaust elbow can be produced. The use of identical parts significantly facilitates the whole assembly.

Because of the individual exhaust pipes manufactured by internal high-pressure metal forming, any manufacturing tolerances are eliminated which result from a displacement of inner pipes situated in the fitted composite which occurs during the individual mounting and joining steps, so that each arbitrary exhaust elbow can be reproduced in a precise manner. The absence of an integral outer jacket and the fastening of the outer jacket half shells on one another as well as of the outer jacket on the entry flanges avoids the difficulties of the previously necessary welding seams resulting from mechanical thermal stress are avoided.

The construction of the outer pipe, which is true to the contours with respect to the course of the inner pipe and its shape, by way of the double pipe which is internal-high-pressure-metal-formed to an air-gap-insulated exhaust pipe, avoids superfluous material of the outer pipe in contrast to the outer jacket of the half shell construction and the space is therefore also reduced.

Overall, the construction of the exhaust elbow can be flexibly adapted to the shape of the provided constructional space because the individual exhaust pipes of the elbow can follow the course of the space because of a suitable successive joining. In contrast, the exhaust elbow in the hollow shell construction would be so voluminous because of a course of the exhaust-gas carrying pipes extending into the constructional depth that an installation is impossible from the start.

Furthermore, as the result of the manufacturing of the exhaust pipes by internal high-pressure metal forming, the air-insulating gap can be adjusted in a targeted and completely uniform manner along the whole course of the exhaust pipe. The joining points of the outer pipes on one another, while forming a surrounding, mechanically very highly stressable fillet weld, are preferably welded together by a laser.

On the whole, as a result of the manufacturing process according to the invention, a high process reliability is achieved, because of the internal high-pressure metal forming, on the one hand, there is no fitted-composite-disintegrating displacement possibility of the inner pipes and, on the other hand, the number of welds is minimized, the exhaust elbow being designed such that only surrounding, mechanically stressable fillet welds, which are easy to construct, are required for the fastening of the individual exhaust pipes to one another and to the entry flanges as well as to the "exist flange".

Other objects, advantages and novel features of the present invention will become apparent from the following detailed description of the invention when considered in conjunction with the accompanying drawings.

DETAILED DESCRIPTION OF THE DRAWINGS

Figure 1:
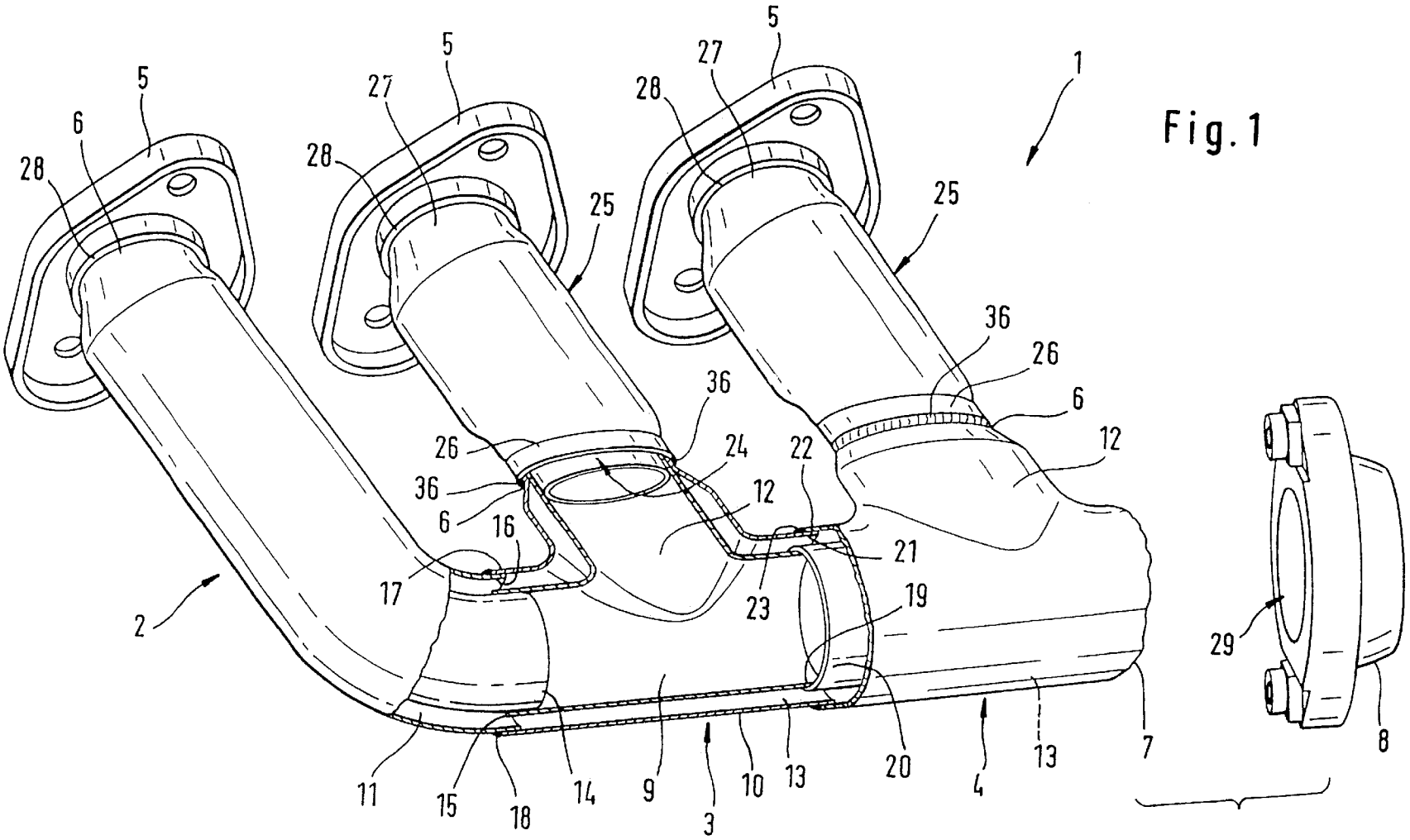
FIG. 1 is a perspective sectional view of an air-gap-insulated exhaust elbow constructed according to the present invention with three joined individual exhaust pipes.

FIG. 1 illustrates an air-gap-insulated exhaust elbow designated generally by numeral 1 which consists of a pipe bend 2, an exhaust pipe 3 branched in a T-shape and an end exhaust pipe 4 also branched in a T-shape. The cylinder-head-facing ends 6 of the exhaust pipes 2, 3 and 4 are connected with entry flanges 5. The illustrated separate entry flanges 5 may also be constructed to be integrated in a common flange strip. The end exhaust pipe 2, 3, 4, via which the exhaust gas flows from all three exhaust pipes 2, 3, 4, is connected, by way of its end 7 which is not connected with respect to its entry flange 5 and the adjoining exhaust pipe 3 situated next thereto and bends slightly downward, directly to the exit flange 8 to which the remaining exhaust gas pipe system is connected.

For manufacturing the exhaust elbow 1, first the pipe bend 2, the exhaust pipe 3 and the end exhaust pipe 4 are each manufactured ready to be joined by internal high-pressure metal forming from a straight double pipe. For this purpose, in a simple manner, first two pipes, which can be produced at low expenditures by being cut to length from a rod, have approximately the same length and extend in a straight line, are fitted into one another completely congruently. The resulting double pipe therefore consists of an inner pipe 9 and outer pipe 10 which coaxially surrounds the inner pipe 9. The construction of these two pipes 9, 10 must not necessarily be straight. The coaxial characteristic must only be ensured which is required for a uniformity of the future air insulating gap, in which case the two pipes 9, 10 must rest against one another at least at one end.

Thus, after being fitted together, the pipes 9, 10 can easily be spaced from one another at one end while forming a ring gap. Their constructions must, however, each be adapted to one another such that they can be fitted into one another in a reliable manner. Before it is fitted in, the inner pipe 9 is perforated on the circumferences of its ends. The inner pipe 9 consists of a high-temperature-resistant material, while the less temperature-stressed outer pipe 10 may consist of a lower-cost, less high-temperature resistant material.

The double pipe, from which the pipe bend 2 is made, is present in a bending device which may also be an internal high-pressure metal forming tool. The double pipe, which is present in a bending device which is separate from the internal high-pressure metal forming tool, is then entered into an internal high-pressure metal forming tool whose die sinking is adapted in its course or shape to the bending course of the bent double pipe but, following the end areas of the double pipe, is concentrically widened. Thereby, an annulus, which is used as an expansion space, is formed between the die sinking and the entered double pipe.

After the closing of the internal high-pressure metal forming tool, the double pipe is sealed off at the end side by axial plungers and is filled by introducing a pressure fluid by way of these plungers. Then the pressure fluid is highly stressed to approximately 700 to 1,000 bar, whereupon the double pipe widens in a simple manner. The end areas of the double pipe, which are enclosed with play by the metal forming tool, are pressed against the die sinking, in which the inner pipe 9 is locked at the circumference at both ends with the outer pipe 10.

By way of the preperforated hole ring of the inner pipe 9, the outer pipe 10 is directly acted upon in the area of the expansion space by pressure fluid, whereby it opens up and is placed against the concentrically widened section of the die sinking, while, the shape of the inner pipe 9 is not impaired by metal forming because of the pressure compensation between the inner pipe 9 and the outer pipe 10 in this section. As a result, a continuous ring gap is generated along this section which forms the desired air-insulating gap 11.

Without a preceding perforation of the inner pipe, the pressure fluid may also be introduced into the parting line of the inner pipe 9 in the outer pipe 10. This approach requires, however, high expenditures, particularly with the additional mounting of starting gaps on the faces of the double pipe in its joining area, and undesirably deforms the end areas of the double pipe. Furthermore, the die sinking of the internal high-pressure metal forming tool, with respect to the outer contour and the diameter, can correspond to the outer pipe 10.

By introducing a pressure fluid between the walls of the inner pipe 9 and of the outer pipe 10, without providing a pressure compensation in the interior of the inner pipe 9, the inner pipe 9 can be compressed by the high fluid pressure, so that the inner pipe lengthens and, because of the compression, moves away from the outer pipe 10, which rests against the die sinking, while forming an air insulating gap. In order to achieve a targeted compression, a continuous tool cylinder can be slid into the inner pipe 9, against which the inner pipe 9 can then place itself.

The manufacture of the branched exhaust pipe 3 takes place in two steps. Starting from the above-mentioned double pipe, this double pipe is not bent but maintains its straight course. In the first step, the double pipe is entered into a first internal high-pressure metal forming tool whose die sinking has a radial branching. After the closing of the first metal forming tool and the sealing of both ends of the double pipe (in which the hole ring of the inner pipe is also sealed off in each case), a pressure fluid is introduced into the inner pipe 9 and is exposed to high pressure. Under the action of the high pressure, corresponding to the shape of the die sinking, a double-walled branching connection piece 12 is blown out of the double pipe. After the shaping of the branching connection piece 12, the pressure is relaxed and the branched T-shaped double pipe is taken out of the first internal high-pressure metal forming tool.

In the second step, the branched double pipe is charged into a second internal high-pressure metal forming tool whose die sinking has a T-shaped construction corresponding to the construction of the double pipe but, following the three end areas of the T-shaped double pipe, is concentrically widened. The end areas are each received in the die sinking with play. The die sinking therefore bounds a T-shaped expansion space together with the double pipe between its end areas. The second internal high-pressure metal forming tool is now closed and the open, mutually opposite end areas of the double pipe are sealed off, in which case the perforation of the inner pipe 9 is freed.

By the application of an internal high pressure after the filling of the inner pipe 9 with pressure fluid, by way of the freely accessible perforation, the outer pipe 10 of the double pipe is acted upon with pressure fluid. Only the outer pipe 10 is widened because of the above-mentioned pressure compensation on the section of the double pipe situated between the end areas, so that an air-insulating gap 13 is created. The three end areas of the inner pipe 9 and the outer pipe 10 are pressed against one another and against the die sinking by internal high pressure, with the inner pipe 9 and the outer pipe 10 locking with one another there. After the concluded metal forming and relaxation and the guiding-out of the pressure fluid as well as the subsequent opening of the second metal forming tool, the now air-gap-insulated, branched exhaust pipe 3 is removed from this second metal forming tool.

Finally, the car area of the branching connection piece 12 is cut off, for example, by laser beam cutting, thereby opening the inner pipe 9 in the branching connection piece 12 toward the outside. This opening can be produced by milling, turning, punching, drilling or similar processes. In addition, during the construction of the branched air-gap-insulated exhaust pipe 3 and 4, the two forming steps can be carried in a single metal forming tool simultaneously or successively within the scope of the present invention in which case, the metal forming tool would then have two die sinkings which are constructed at a distance with respect to one another which is process-safe.

The manufacture of the end exhaust pipe 4 is identical to that of the above-described branched exhaust pipe 3. With respect to the construction of its end 7 which is slightly curved in the downward direction, the end exhaust pipe 4 can be present or assume its bent shape by the internal high-pressure metal forming in the first step corresponding to the shape of the die sinking.

The mutually opposite ends of the end exhaust pipe 4 as well as of the exhaust pipe 3 are trimmed by laser cutting so that the air insulating gap 13 is opened there. Likewise, the pipe bend 2 is trimmed on one end, whereby its air insulating gap 11 is opened up at this point. At the opened end of the pipe bend 2, the end 14 of its inner pipe 9 is fitted into an end 15 of the inner pipe 9 of the opened end of the exhaust pipe 3, and the end 16, which is located there, of the outer pipe 10 of the pipe bend 2 is fitted into an end 17 of the outer pipe 10 of the exhaust pipe end situated there, by way of a sliding fit. The two outer pipes 10 are then welded together by laser welding from the outside at their overlapping point while forming a surrounding fillet weld 18.

At the opposite end of the exhaust pipe 3 facing away from the pipe bend 2, the end 19 of the inner pipe 9 is fitted into the end 20 of the inner pipe 9 of the straight opened end of the end exhaust pipe 4. Likewise, the end 21, which is situated there, of the outer pipe 10 of the exhaust pipe 3 is fitted into the end 22 of the outer pipe 10 of the end exhaust pipe 4, by a sliding fit. The outer pipes 10 are also welded together at their overlapping point by laser welding while forming a surrounding fillet weld 23.

Subsequently, the ends 6 of the exhaust pipes 3, 4, thus the ends of the branching connection pieces 12, are fitted into tapered air insulating gaps 24 of short straight air-gap-insulated exhaust pipes 25, in which the open end 26, which is used for the plug-type connection with the branching connection piece 12, together with its inner pipe 9, is fitted by way of a sliding fit into the inner pipe 9 of the branching connection piece 12. The double-walled end 5 of the branching connection pieces 12, which rests on the inside against the outer pipe 10 of the respective exhaust pipe 25, can then be welded to its outer pipe 10 by laser welding while forming the above-mentioned surrounding fillet weld 36.

In addition, the air insulating gap 24 of the exhaust pipes 25 is also constructed by internal high-pressure metal forming, specifically in the same manner as the pipe bend 2, but without the bending of the double pipe. At the still connection-free end 6, 27, the inner pipes 9 of the exhaust pipes 25 and of the pipe bends 2 remain locked with the outer pipes 10. Thereby the air insulating gap is closed there, and the inner pipe fitted composite within the outer pipe welded fitted composite remains fixed in its centered position.

Figure 2:
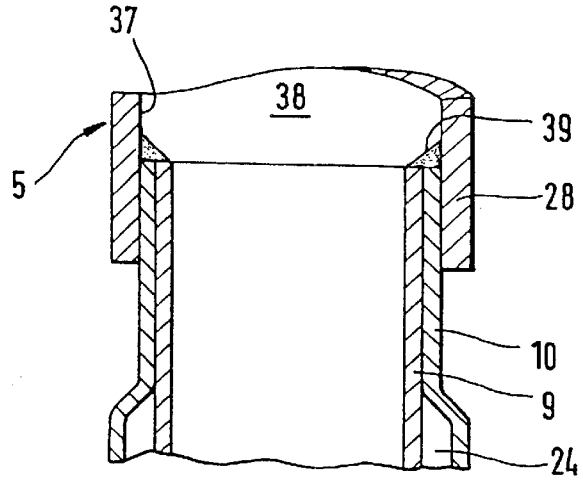
FIG. 2 is a lateral longitudinal sectional view of the connection point between the exhaust pipe ends of the exhaust elbow according to FIG. 1 and the respective entry flange with a closed air insulating gap.

Now, the fitted welded composite of the exhaust pipes 2, 3, 4, 25 is fitted by the end 6 of the pipe bend 2 and the end 27 of the exhaust pipes 25 into the passage openings 38 of the entry flanges 5 (as seen in FIG. 2), after which the ends of the inner pipe 9 and of the outer pipe 10, which are situated there and close off flush with one another, are welded by laser welding to the opening wall 37 of the passage opening 38 while forming a surrounding fillet weld 39. Because the locking effect of the inner pipe 9 and of the outer pipe 10 on one another ensures the gas tightness of the air insulating gap 11 and 24, individual welding points may also be completely sufficient for fastening the pipe bend end 6 and the ends 27 of the exhaust pipes 25 in the entry flange 5.

Furthermore, the inner pipe 9 and the outer pipe 10 can be of different lengths, after which their ends will then not close off flush with one another. For fastening the thus configured ends 6, 27 at the opening wall 37 of the passage opening 38 of the respective entry flange 5, only two thin weld seams are required, in which case, while forming one fillet weld respectively, an end of the inner pipe 9 is welded to the inner side of the outer pipe 10 and the end of the outer pipe 10 is welded to the opening wall 37 of the entry flange passage opening 38.

As an alternative, the ends 6, 27 of the exhaust pipes 2, 27 can be filtered onto a cylindrical projection 28 surrounding the passage opening 38 and welded from the outside in a surrounding manner to the projection. This alternative is suitable, however, only to a limited degree because the welding point is difficult to access by the welding laser.

Furthermore, the exhaust pipes 25 and their mounting to the exhaust pipes 3, 4 can be eliminated and a shorter pipe bend 2 can be simultaneously provided. The exhaust pipes 3, 4 are connected directly to the entry flanges 5, with this approach which significantly compacts the elbow 1 overall and thereby saves space. If the constructional concept with respect to the engine is such that parts of the transmission line are provided in the area of the entry flanges 5, the exhaust pipes 3, 4 will be in the way, whereby the connection exhaust pipes 25 become engaged. As an adaptation to the mentioned transmission line parts, these may, in addition, have a bent construction.

Figure 3:
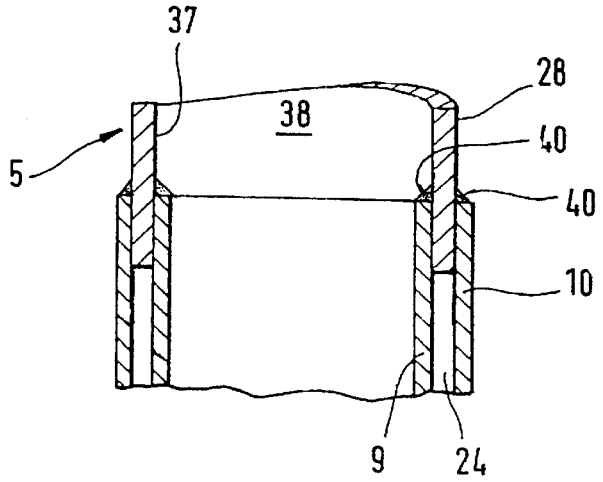
FIG. 3 is a lateral longitudinal sectional view of the connection point between the exhaust pipe ends of the exhaust elbow similar to FIG. 1 but the respective entry flange with an open air insulating gap.

Referring to FIG. 3, it is also contemplated that after an appropriate trimming of the ends 6 of the exhaust pipes 2, 3, 4 and 25, the air insulating gaps 11, 13, 24 can be configured to be open on the entry flange side and to fit the respective entry flange 5 by way of its cylindrical projection 28 into the air insulating gaps 11, 13, 24. Thereafter, the outer pipe 10 is welded from the outside, and the inner pipe 9 is welded from the inside while forming a fillet weld 40 by a laser to the projection 28 of the entry flange 5.

Because the centering of the inner pipes 9 of all exhaust pipes 2, 3, 4, 25 must be ensured in their outer pipes 10, and thus the existence of the air insulating gaps 11, 13, 24 must be ensured, the mounting of the exhaust elbow 1 must take place as follows. The other ends of the exhaust pipes 2, 3, 4 and 25 must first have inner pipes 9 and outer pipes 10 which were previously locked to one another, in which case the air insulating gaps 11, 13, 24 are closed there. Then, the respective exhaust pipe 2, 3, 4 and 25 is fastened to the entry flange 5, whereby the inner pipes 9 are centrically fixed in the outer pipes 10 and are therefore continuously air-gap-insulated. Thereafter, the other ends, in which end 7 of the end exhaust pipe 4 may be excluded, of the exhaust pipes 2, 3, 4 and 25 are trimmed so that the respective air insulating gaps 11, 13, 24 are opened up. It is only now that the above-mentioned joining step takes place in the first variant and during which the inner and the outer pipes 9, 10 are fitted into one another, and then the outer pipes 10 are laser-welded to one another in a surrounding manner.

Figure 4:
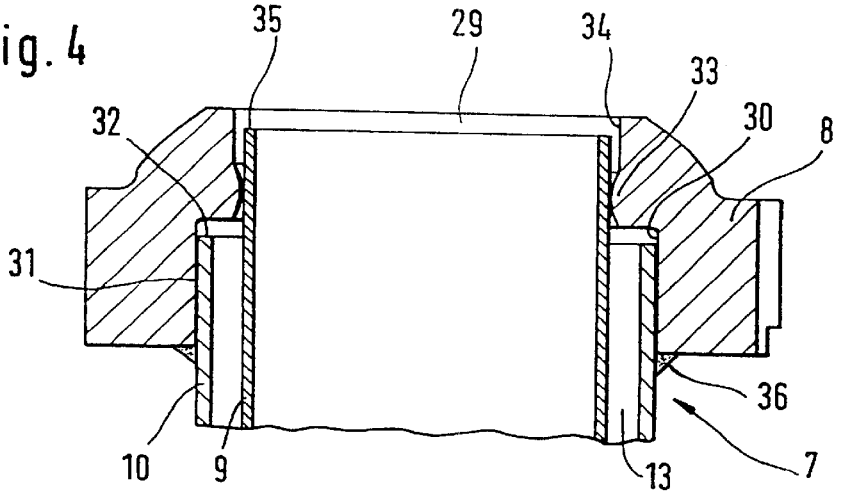
FIG. 4 is a lateral longitudinal sectional view of the connection point between an exhaust pipe end of the exhaust elbow similar to FIG. 1 but the exit flange with a closed air insulating gap.

Finally, as seen in FIG. 4, the joining of the exit flange 8 takes place. The end 7 of the end exhaust pipe 4, which is formed by the last one of the branched exhaust pipes 3, 4 arranged in a row next to one another from the direction of the pipe bend 2, is fitted into the passage opening 29 of the flange 8. For this purpose, the passage opening 29 initially has a step-type cylindrical widening 30, whose circumference corresponds to that of the outer pipe 10 of the end exhaust pipe 4, so that, when the pipe end 7 is fitted in, the outer pipe 10 rests on its outer side 31 against the circumference of the expansion 30. In addition, the outer pipe 10 can also rest by its face 32 on the step of the expansion 30; thereby, as the result of the stop, the outer pipe 10 has a defined relative fitted position in the exit flange 8.

The end 7 of the end exhaust pipe 4 is trimmed such that the locking of the pipe 4 is eliminated and the air insulation gap 13 is opened up. Furthermore, the inner pipe 9 projects out of the outer pipe 10. The step of the expansion 30 projects over the outer pipe 10 radially to the interior by the extent of the width of the air insulating gap 13. On the wall 34 of the passage opening 29, directly adjoining the step, a surrounding contact bead 33 is constructed, against which the free end 35 of the inner pipe 9 of the exhaust pipe 4 is guided by means of a sliding fit. After the insertion from the outside, the outer pipe 10 is welded to the exit flange 8 in a surrounding manner by a laser or similar beam welding process while forming a fillet weld 36.

Furthermore, it is within the scope of the present invention to insert, in spaces of uncomplicated configurations, air-gap-insulated connection pipes between the exhaust pipes 2, 3 and 4. The connection pipes are constructed in a straight or bent shape such that the exhaust elbow 1 can be optimally adapted to the space situation and requires only low mounting expenditures.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Process for manufacturing an air-gap-insulated exhaust elbow for an exhaust system of a motor vehicle, comprising:

(i) providing a plurality of exhaust pipes, a plurality of entry flanges, and an exit flange, wherein each exhaust pipe is a double pipe comprising an inner pipe and an outer pipe, wherein the inner pipe for each exhaust pipe defines an exhaust pipe internal passageway;

(ii) shaping the exhaust pipes into a pipe-bend-shaped exhaust pipe and at least one branched exhaust pipe, forming an air-insulating gap in each exhaust pipe by internal high pressure forming, wherein the at least one branched exhaust pipe includes two non-branched ends and an air-gap-insulated branch with a double-walled end lacking an air-insulated gap;

(iii) removing a section of the double-walled end of the branch of the at least one branched exhaust pipe to provide an opening to the exhaust pipe internal passageway without opening the air-insulating gap;

(iv) joining together the plurality of air-gap-insulated exhaust pipes to form an exhaust elbow, wherein the exhaust pipes are connected such that an exhaust elbow inner passageway and at least one exhaust elbow air-insulating gap are formed thereby; and (v) connecting the entry flanges and the exit flange to the exhaust elbow to permit connection of the exhaust elbow to a motor vehicle exhaust system.

2. The process of claim 1, further comprising, after step (iii), the step of trimming the non-branched ends of the at least one branched exhaust pipe for connection with other exhaust pipes such that the air-insulating gap between the outer pipe and inner pipe of the at least one branched exhaust pipe is opened up; trimming an end of the pipe-bend-shaped exhaust pipe for connection with one of the trimmed ends of the at least one branched exhaust pipe such that the air-insulated gap between the outer pipe and inner pipe of the pipe-bend-shaped exhaust pipe is opened up; wherein the trimmed ends of the pipe-bend-shaped exhaust pipe and the at least one branched exhaust pipe are shaped to connect with one another such that the respective inner pipes and outer pipes connect with play.

3. The process of claim 2, further comprising welding together the connection of at least the outer pipes of the exhaust pipes.

4. The process of claim 2, further comprising welding together the connection of the entry flanges and exist flange to the respective exhaust pipes.

5. The process of claim 3, wherein the connection is welded with a surrounding fillet weld.

6. The process of claim 4, wherein the connection is welded with a surrounding fillet weld.

7. The process of claim 2, wherein fitted interconnections between the respective ends of the inner pipes and outer pipes of the exhaust pipes connect the exhaust pipes together.

8. The process of claim 1, wherein each double pipe is formed by fitting the inner pipe inside the outer pipe so that the inner pipe and outer pipe are coaxially arranged, fit together with play, and rest against one another at least on one end.

9. The process of claim 8, wherein the outer pipe and the inner pipe of each double pipe are straight.

10. The process of claim of 9, further comprising bending one double pipe, prior to the internal high pressure forming of step (ii), in forming the pipe-bend-shaped exhaust pipe.

11. The process of claim 10, further comprising bending the one double pipe in an internal high pressure forming tool.

12. The process of claim 1, wherein the air-insulating gap in each exhaust pipe is formed in an internal high pressure forming tool by expanding the outer pipe with an internal high pressure fluid.

13. The process of claim 1, further comprising, in step (ii), in a first metal forming step (a), forming the branch of the at least one branched exhaust pipe by internal high pressure forming, wherein the branch is double-walled, and, in a second metal forming step (b), forming an air-insulating gap between the inner pipe and outer pipe, including in the double-walled branch, by enlarging the outer pipe with an internal high pressure fluid.

14. The process of claim 13, further comprising performing the second metal forming step (b) in a second internal high pressure metal forming tool different than the first metal forming step (a) which is performed in a first internal high pressure metal forming tool.

15. The process of claim 1, further comprising, in step (iii), removing the section of the double-walled end of the branch by laser beam cutting.

16. The process of claim 1, further comprising, in step (ii), shaping at least one exhaust pipe as an essentially straight, air-gap-insulated exhaust pipe, and further comprising, in step (iv), connecting the pipe-bend-shaped exhaust pipe with the at least one essentially straight, air-gap-insulated exhaust pipe, wherein the straight exhaust pipe is connected to an entry flange.

17. The process of claim 1, further comprising, in step (ii), shaping at least one exhaust pipe as an essentially straight, air-gap-insulated exhaust pipe, and further comprising, in step (iv), connecting the at least one branched exhaust pipe with the at least one essentially straight, air-gap-insulated exhaust pipe, wherein the straight exhaust pipe is connected to an entry flange.

18. The process of claim 1, further comprising, in forming the exhaust elbow, providing and joining together at least one connection pipe with the plurality air-gap-insulated exhaust pipes, wherein the at least once connection pipe is selected from the group consisting of an at least essentially straight connection pipe and a bent connection pipe.

19. The process of claim 18, further comprising, in forming the exhaust elbow, joining together a plurality of branched exhaust pipes interconnected with a plurality of connection pipes.

20. The process of claim 1, further comprising in step (ii) locking together with radial contact pressure, in a flush manner, one end of the inner pipe with one end of the outer pipe for each exhaust pipe to be connected with an entry flange, forming a radially locked end which is capable of fitting into a passage opening of one of the entry flanges.

21. The process of claim 20, further comprising fitting the radially locked end of each exhaust pipe to be connected with an entry flange into the passage opening of the respective entry flange and fixedly connecting the entry flange to the exhaust pipe with a surrounding fillet weld.

22. The process of claim 1, further comprising trimming ends of the inner pipe and the outer pipe of each exhaust pipe to be connected with one of the entry flanges having a cylindrical opening around a passage opening, thus opening up the air-insulating gap, and fitting the cylindrical projection of the one of the entry flanges into the air-insulating gap between the trimmed ends of the respective inner pipe and outer pipe of the respective connecting exhaust pipe, and fixedly connecting the cylindrical projection thereto.

23. The process of claim 22, further comprising fixedly connecting the cylindrical projection to the respective connecting exhaust pipe by a surrounding fillet weld.

24. The process of claim 1, further comprising trimming ends of the inner pipe and the outer pipe of the at least one branched exhaust pipe to be connected with the exit flange, the exit flange having a passage opening.

25. The process of claim 24, further comprising fixedly connecting the trimmed end of the outer pipe to the exit flange by a surrounding fillet weld.

* * * * *